US010153547B2

(12) United States Patent
Crouch

(10) Patent No.: US 10,153,547 B2
(45) Date of Patent: Dec. 11, 2018

(54) ARMORED RADOME

(71) Applicant: Raytheon Company, Waltham, MA (US)

(72) Inventor: David D. Crouch, Corona, CA (US)

(73) Assignee: RAYTHEON COMPANY, Waltham, MA (US)

( * ) Notice: Subject to any disclaimer, the term of this patent is extended or adjusted under 35 U.S.C. 154(b) by 537 days.

(21) Appl. No.: 14/800,208

(22) Filed: Jul. 15, 2015

(65) Prior Publication Data

US 2018/0094909 A1 Apr. 5, 2018

(51) Int. Cl.

| | |
|---|---|
| ***H01Q 1/42*** | (2006.01) |
| ***F41H 5/04*** | (2006.01) |
| ***F41H 13/00*** | (2006.01) |
| ***F42B 10/46*** | (2006.01) |
| *H01Q 1/27* | (2006.01) |

(52) U.S. Cl.

CPC ..... *H01Q 1/425* (2013.01); *F41H 5/0457* (2013.01); *F41H 13/0068* (2013.01); *F42B 10/46* (2013.01); *H01Q 1/273* (2013.01)

(58) Field of Classification Search

CPC ..... H01Q 1/42–1/428; H01Q 1/273; F41H 5/0457; F41H 13/0068

See application file for complete search history.

(56) References Cited

U.S. PATENT DOCUMENTS 3,310,808 A * 3/1967 Friis ..... H01Q 1/425 343/872
3,334,349 A * 8/1967 Wheeler ..... H01Q 1/425 333/33
3,448,455 A * 6/1969 Alfandari ..... H01Q 19/195 343/756
4,570,166 A 2/1986 Wu
5,103,241 A * 4/1992 Wu ..... H01Q 15/0026 343/872
5,140,338 A * 8/1992 Schmier ..... H01Q 1/42 343/700 MS
5,182,155 A * 1/1993 Roe ..... B32B 3/12 428/116
5,208,603 A * 5/1993 Yee ..... H01Q 1/286 343/872
5,861,860 A * 1/1999 Stanek ..... H01Q 1/421 343/708
6,297,774 B1 * 10/2001 Chung ..... H01Q 21/0087 343/700 R
7,132,990 B2 * 11/2006 Stenger ..... H01P 1/047 343/754

(Continued)

FOREIGN PATENT DOCUMENTS

CN 102709695 A * 10/2012
DE 19830791 A1 9/1999

OTHER PUBLICATIONS

ISR/WO, dated Aug. 19, 2016, RAY0310PCT, PCT Application No. PCT/US2016/031737.

*Primary Examiner* — Matthew M Barker

(74) *Attorney, Agent, or Firm* — Cantor Colburn LLP

(57) ABSTRACT

An armored radome is provided and includes a metallic plate formed to define an array of through-holes. Each through-hole has a respective longitudinal axis substantially aligned with electromagnetic radiation passing locally through the metallic plate.

19 Claims, 6 Drawing Sheets

(56) References Cited

U.S. PATENT DOCUMENTS

| | | | | |
|---|---|---|---|---|
| 7,688,278 | B2 * | 3/2010 | Frenkel | H01Q 1/002 343/872 |
| 7,817,099 | B2 | 10/2010 | Wu | |
| 8,054,239 | B2 | 11/2011 | Wu | |
| 8,125,402 | B2 * | 2/2012 | Crouch | H01Q 1/02 343/705 |
| 8,350,751 | B2 * | 1/2013 | Edvardsson | H01Q 1/225 342/124 |
| 8,368,610 | B2 * | 2/2013 | Kviatkofsky | F42B 10/46 343/872 |
| 9,257,743 | B2 * | 2/2016 | Brady | H01Q 1/422 |
| 9,385,423 | B2 * | 7/2016 | Boutigny | H01Q 1/42 |
| 2003/0001699 | A1 * | 1/2003 | Crouch | H01P 1/08 333/252 |
| 2008/0122725 | A1 | 5/2008 | Navarro et al. | |
| 2009/0174621 | A1 | 7/2009 | Crouch et al. | |
| 2017/0301980 | A1 * | 10/2017 | Lavin | B64C 3/26 |

* cited by examiner

FIG. 1A
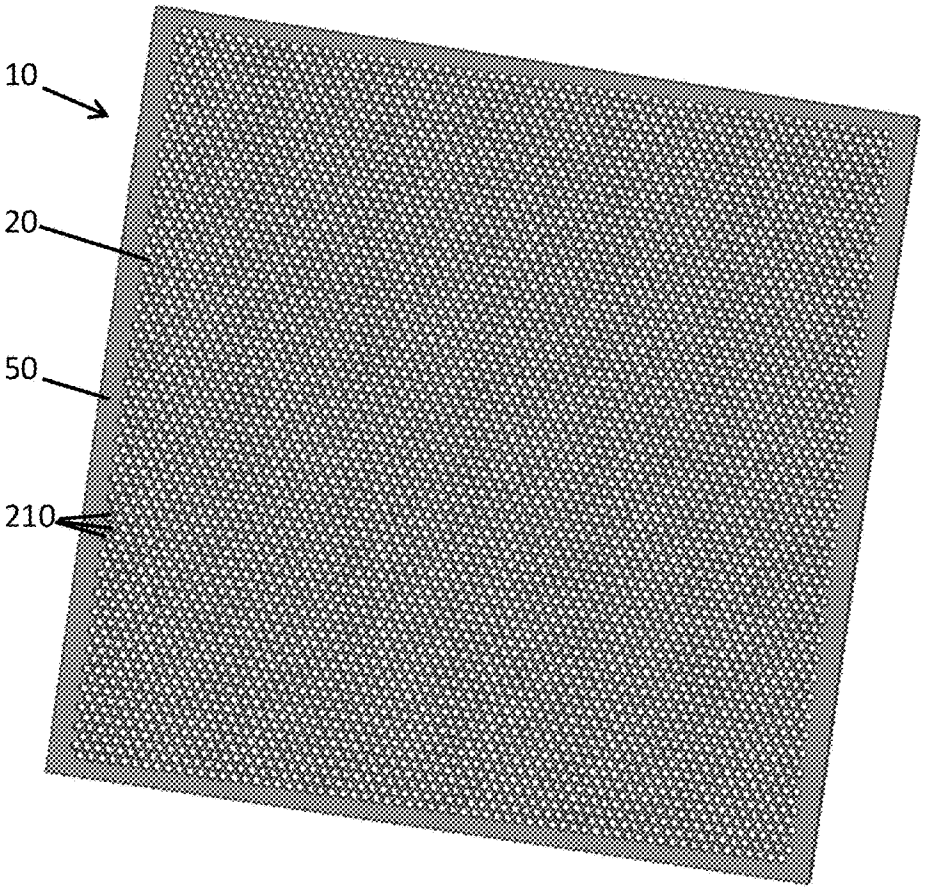
FIG. 1B
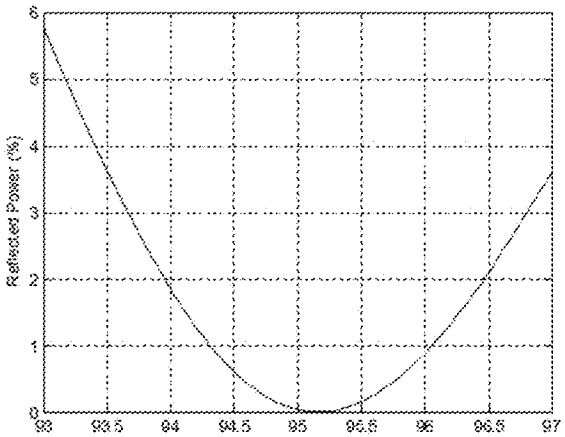
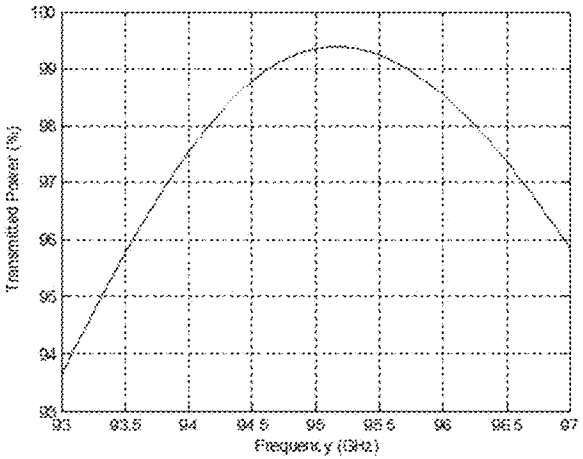
FIG. 1C

ARMORED RADOME

BACKGROUND

The present invention relates to an armored radome and, more specifically, to an armored millimeter wave radome.

Solid State Active Denial Technology (SSADT) relates to non-lethal, directed-energy weaponry that is designed for area denial, perimeter security and crowd control. Generally, SSADT works by heating the surface of targets, such as the skin of targeted human subjects, and has a range of about 0-100 meters (m). Implementations of SSADT can be provided as vehicle-mounted weapons or as hand-carried, portable weapons. In the former case, an SSADT system can be attached to any ground vehicle in a manner similar to the installation of the Common Remotely Operated Weapon System (CROWS) without adversely impacting the operation of the vehicle and has an output power of about 6.7 kW, an aperture size of about 25.6"×25.6" with a capability to deliver an 18" diameter spot size out to a range of 100 m.

Even though SSADT relates to non-lethal weaponry intended for engagements not involving armed conflict, an armored radome will still be required for handling unforeseen instances arising during those engagements. Indeed, the transition from a non-lethal to a lethal engagement and vice versa can occur at almost any point in the operation of a vehicle equipped with SSADT. For instance, during an armed conflict, a child sent out to retrieve weapons could be safely engaged and prevented from doing the job he was sent out to do without resorting to lethal force. Alternatively, if a vehicle is patrolling an area with civilians and insurgents, any civilians obstructing vehicle mobility can be safely shoved out of the way using SSADT. In this situation, where open hostilities are not in play, SSADT may be a better option than conventional kinetic based non-lethal weapons due to SSADT being silent, invisible and capable of delivering a shove effect at the speed of light whereas kinetic non-lethal weapons are noisy, very visible and can draw a crowd rather than achieve the desired de-escalation.

SUMMARY

According to one embodiment of the present invention, an armored radome is provided and includes a metallic plate formed to define an array of through-holes. Each through-hole has a respective longitudinal axis substantially aligned with electromagnetic radiation passing locally through the metallic plate.

According to another embodiment, an armored radome is provided and includes at least first, second and third dielectric plates and at least first and second metallic plates respectively interleaved between the at least first, second and third dielectric plates. The first metallic plate defines a first array of first through-holes each of which has a respective longitudinal axis substantially aligned with electromagnetic radiation passing locally through the first metallic plate. The second metallic plate defines a second array of second through-holes each of which has a respective longitudinal axis substantially aligned with electromagnetic radiation passing locally through the second metallic plate.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

FIG. 1A is a plan view of an armored radome in accordance with embodiments;

FIG. 1B is a graphical display of reflected power vs. frequency (GHz) for the armored radome of FIG. 1A;

FIG. 1C is a graphical display of transmitted power vs. frequency (GHz) for the armored radome of FIG. 1A;

DETAILED DESCRIPTION

Figure 2:
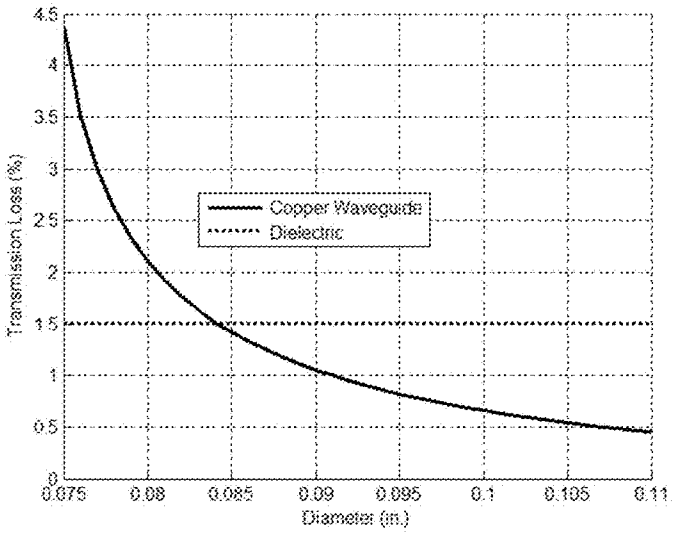
FIG. 2 is a graphical illustration of transmission loss vs. diameter for a single isolated circular waveguide that may be used as part of the armored radome of FIG. 1A.
Figure 3:
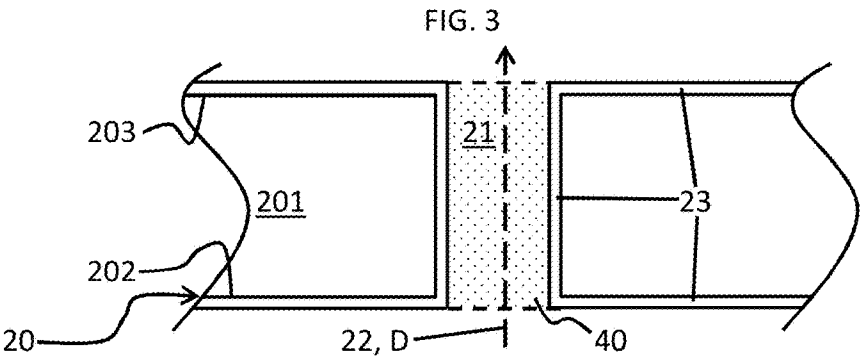
FIG. 3 is a side schematic view of a portion of the armored radome of FIG. 1A.

As will be described below, an armored wideband or W-band radome is provided to enhance an overall utility of an SSADT system. Such a radome would protect the system against incidental gunfire and eliminate the need to put the system on and off a vehicle and to anticipate when non-lethal engagements are required. The armor of the radome demands some minimal radome thickness, which must be balanced against the need to keep transmission losses low and the need to maintain reasonable fabrication tolerances. The wideband design approach allows the radome to operate over a greater-than-required frequency range and permits some degree of built in immunity to normal fabrication variations. Thus, while a significant impact of manufacturing variations on radome performance is often to shift the optimal operating frequency away from the design frequency, effects of such variations can be minimized or negated with sufficient bandwidth built in.

With reference to FIGS. 1A, 1B, 1C, 2 and 3, an armored radome 10 is provided that meets at least two operational requirements. The armored radome 10 allows low-loss propagation of incident microwave (hereinafter referred to as "electromagnetic" or "EM") radiation and offers ballistic protection by stopping incident projectiles. The armored radome 10 includes a metallic plate 20 having a body 201, a first side 202 and a second side 203 opposite the first side 202. The body 201 is formed to define an array of through-holes 21 extending from the first side 202 to the second side 203. The armored radome 10 may be arranged in, for example, an SSADT system such that electromagnetic radiation passes through the armored radome 10 in a propagation direction D (see FIG. 3) from the first side 202 to the second side 203. Each through-hole 21 in the array has a respective longitudinal axis 22, which is configured to be substantially aligned with the propagation direction D for electromagnetic radiation passing locally through the metallic plate 20.

The low-loss propagation capability of the armored radome 10 is provided by the body 201 being formed of materials that have favorable electrical properties while the capability of the armored radome 10 to offer ballistic protection is provided by the body 201 being formed to have favorable mechanical properties and sufficient thickness from the first side 202 to the second side 203. Thus, to provide the armored radome 10 with W-band capability appropriate for an SSADT system, in particular, a first design consideration may relate to material choice for the body 201.

To this end, it is understood that a given dielectric material is characterized by its relative dielectric constant $\in_R$, relative magnetic permeability $\mu_R$ and loss tangent tan δ and that a wave of frequency f that propagates through a slab of thickness L of a low-loss material decays exponentially as exp(−αL), where the following equation is true.

$$\alpha = \frac{2\pi f\sqrt{\mu_R \epsilon_R}}{c}\left\{\frac{1}{2}\left[\sqrt{1+(\tan\delta)^2}-1\right]\right\}^{1/2}$$

Because the absorption coefficient ac increases linearly with frequency, the loss experienced by a wave propagating a distance L through such a material increases exponentially with frequency. That is, if a wave decays at a rate exp(−βx) at 10 GHz, it will decay at a rate exp(−10βx) at 100 GHz, assuming $\in_R$, $\mu_R$, and tan δ remain constant with frequency. This illustrates that it may be useful to use very low-loss materials at frequencies near 100 GHz such as those present in an SSADT system.

It is further understood that high conductivity materials, such as copper, are often used in fabricating low-loss transmission structures, such as waveguides. In particular, the attenuation of a wave propagating through a circular waveguide of radius, a, in the fundamental $TE_{11}$ mode is given by:

$$\alpha_{TE_{11}} = \frac{1}{\sigma\delta a\eta}\frac{1}{\sqrt{1-\left(\frac{f_c}{f}\right)^2}}\left[\left(\frac{f_c}{f}\right)^2+\frac{1}{(\chi'_{11})^2-1}\right].$$

Here, σ is an electrical conductivity, $\delta=1/\sqrt{\pi f\mu\sigma}$ is the skin depth, $\chi'_{11}=1.8412$ is the first zero of the 1st derivative of the 1st order Bessel function $J'_1(x)$, and $f_c=\chi'_{11}c/(2\pi\alpha)$ is the $T_{11}$ mode cutoff frequency. Single-pass transmission loss as a function of waveguide diameter is plotted in FIG. 2 for a 1 inch waveguide length at a frequency of 95 GHz. Also plotted for comparison is the single-pass transmission loss for propagation through 1 inch of a representative ceramic-type low-loss dielectric material having $\in_R=9.0$ and tan $\delta=1\times10^{-4}$. As shown, waveguide attenuation increases rapidly at the low end of the range because, at 95 GHz, the circular waveguide tends to go into a cutoff mode at a diameter of 0.0728 inches. As is also shown, waveguide loss decreases rapidly with increasing diameter, and falls below that of the low-loss dielectric for diameters greater than 0.084 inches and a circular copper waveguide may be provided as a very low-loss W-band transmission medium.

With the above in mind, the armored radome 10 may be provided such that the array of the through-holes is defined by the body 201 as a periodic array (e.g., with a substantially uniform hexagonal lattice) with the through-holes 21 having substantially circular cross-sectional shapes to act as waveguides 210 (see FIG. 1A) for the electromagnetic radiation. In particular, the armored radome 10 may have about 8" sides and may be about 0.250-1.00" thick, inclusively. The through-holes 21 may have inside diameters of about 0.090-0.094" with a center-to-center spacing of about 0.115". Ballistic and electrical performance of the armored radome 10 may be provided by fabrication of the body 201 from steel (e.g., AR500 abrasion-resistant steel) or another similar metal or metallic material and coating the body 201 with a coating 23 formed of a high-electrical conductivity metallic plating, such as copper.

As shown in FIGS. 1B and 1C, with the above-described configuration, electrical performance of the armored radome 10 exhibits that less than 6% of incident power is reflected between 93 and 97 GHz, while greater than 93% of the incident power is transmitted over the same frequency range. In addition, at an SSADT operating frequency of 95 GHz, the armored radome 10 exhibits a reflected power characteristic of less than 1% and a transmitted power characteristic exceeding 99%.

Figure 4:
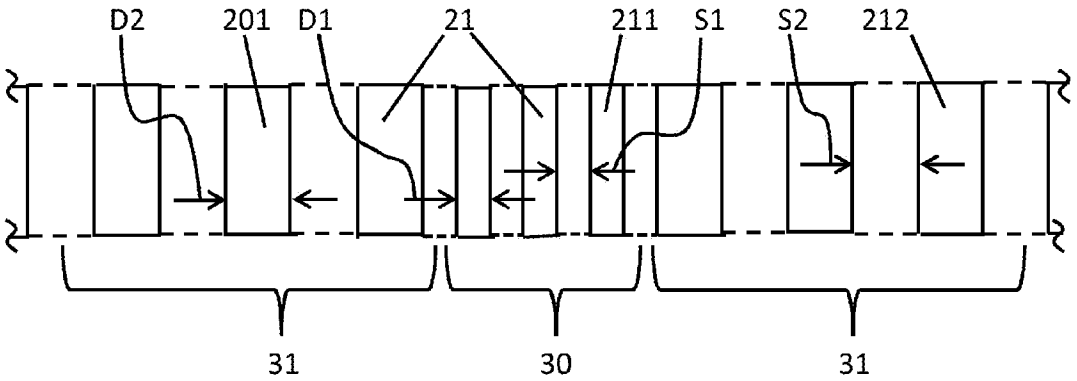
FIG. 4 is a side schematic view of multiple portions of the armored radome of FIG. 1A in accordance with alternative embodiments.

In accordance with embodiments, the array of the through-holes 21 may be generally uniform throughout an entirety of the armored radome 10, as shown in FIG. 1A. However, in accordance with alternative embodiments and, with reference to FIG. 4, the body 201 of the armored radome 10 may be formed to define varying or multiple portions 30, 31 of the body 201 with each of the multiple portions 30, 31 having varying through-hole 21 geometries. That is, the armored radome 10 may be provided with portion 30 (i.e., a central portion 30) and a portion 31 (i.e., a peripheral portion 31). In portion 30, the through-holes 21 are provided as first waveguides 211 that have a first inside diameter D1 and a first center-to-center spacing S1. By contrast, in portion 31, the through-holes 21 are provided as second waveguides 212 that have a second inside diameter D2 and a second center-to-center spacing S2. Portions 30 and 31 have similar thicknesses. As such, the armored radome 10 of FIG. 4 may be transparent to electromagnetic radiation in multiple ranges with similar low loss capability and ballistic resistance at each portion 30, 31.

Figure 5:
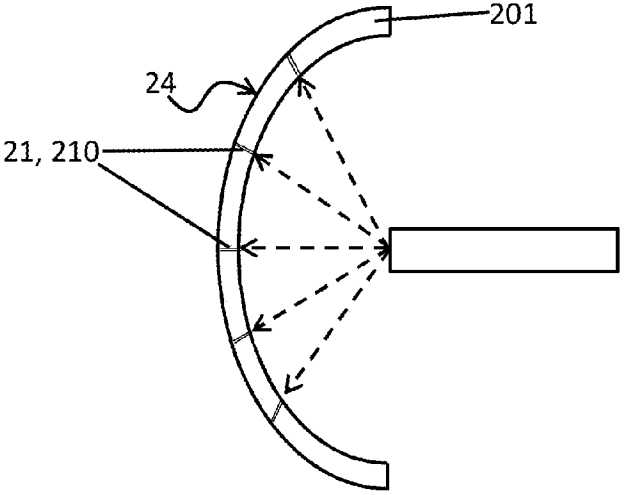
FIG. 5 is a side schematic view of an armored radome having a curvature.

In accordance with embodiments, the armored radome 10 may be substantially flat and planarized, as shown in FIG. 1A. However, in accordance with alternative embodiments and, with reference to FIG. 5, the body 201 of the armored radome 10 may be formed with a curvature 24. In such cases, the through-holes 21 may be oriented to extend through the body 21 in parallel with the electromagnetic radiation such that the through-holes 21 continue to act as waveguides 210 (211, 212) as described above.

With reference back to FIGS. 1A and 3, the armored radome 10 may include dielectric filler 40 (see FIG. 3), which is disposed in the through-holes 21, and a dielectric material or plate 50 (see FIG. 1A). The dielectric filler 40 may permit through-hole 21 size reductions but may lead to increased transmission losses due to increased surface current density. The dielectric plate 50 is disposed adjacent to the body 201 and may be formed of dielectric impedance-matching materials, such as air and high-density polyethylene or other similar materials. Where the body 201 is substantially flat and planarized, the dielectric plate 50 may also be substantially flat and planarized. Conversely, wherein the body 201 is formed with curvature 24, the dielectric plate 50 may also be formed with a corresponding curvature. In either case, the dielectric plate 50 may be attached to the body 201 by way of adhesive or mechanical fastening features. In accordance with embodiments, another dielectric material, such as air, may be disposed between the dielectric plate 50 and the body 201 (see, e.g., FIG. 7).

Figure 6:
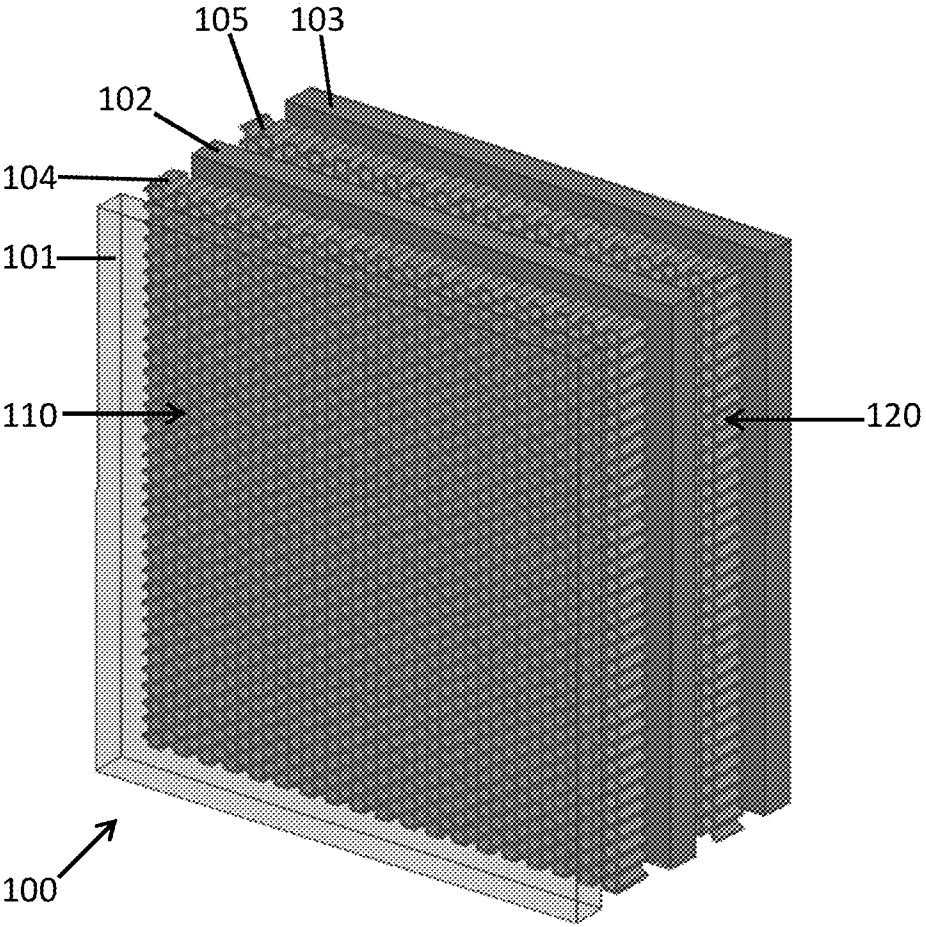
FIG. 6 is a perspective view of an armored radome having multiple metallic and dielectric plates in accordance with further embodiments.
Figure 7:
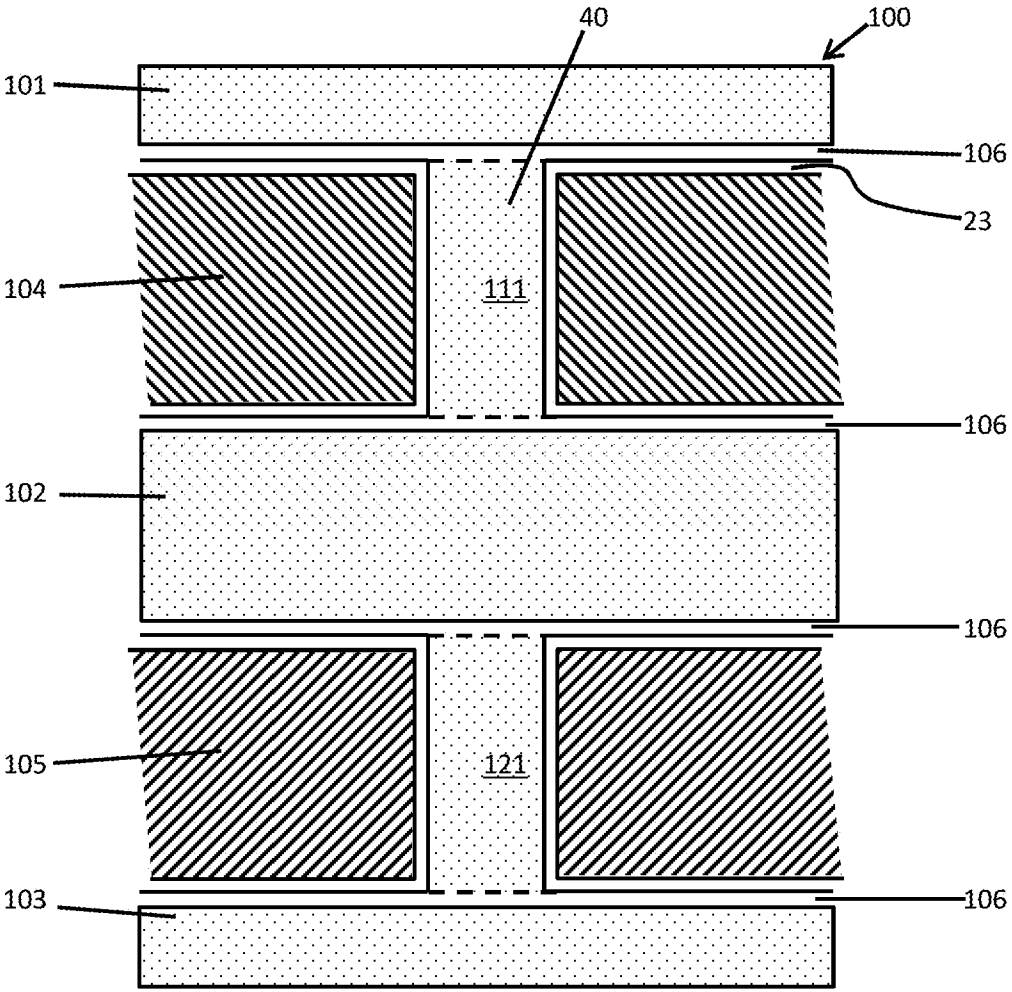
FIG. 7 is a side schematic view of the armored radome of FIG. 6.

In accordance with further embodiments and, with reference to FIGS. 6 and 7, an armored radome 100 is provided and includes at least first, second and third dielectric plates 101, 102 and 103 and at least first and second metallic plates 104 and 105. The first and second metallic plates 104 and 105 are respectively interleaved between the first, second and third dielectric plates 101, 102 and 103. The first and second metallic plates 104 and 105 may be formed in a similar fashion as the body 201 of the armored radome 10 described above and thus descriptions of similar features need not be described again. However, it is to be understood that the first, second and third dielectric plates 101, 102 and 103 may be formed of similar or differing materials and that the first and second metallic plates 104 and 105 may be formed of similar or differing materials and may have similar or different arrays of through holes.

Respective thicknesses of the first, second and third dielectric layers 101, 102 and 103 can be varied to correspondingly vary a distance between the first and second metallic plate 104 and 105. Such variable distance capability in concert with air gaps 106 between the first and second metallic plates 104 and 105 and the first, second and third dielectric layers 101, 102 and 103 allows the armored radome 100 to be tuned for performance. In addition, the armored radome 100 can be configured to accept both orthogonal incident linear polarizations, may exhibit low-loss performance between 93 and 97 GHz and can be further configured to accommodate electronic steering.

In accordance with embodiments, the first metallic plate 104 is formed to define a first array 110 (see FIG. 6) of first through-holes 111 (see FIG. 7). Each of the first through-holes 111 has a respective longitudinal axis that is configured to be substantially aligned with a propagation direction of electromagnetic radiation that passes locally through the first metallic plate 104. The second metallic plate 105 is formed to define a second array 120 (see FIG. 6) of second through-holes 121 (see FIG. 7). Each of the second through-holes 121 has a respective longitudinal axis that is configured to be substantially aligned with a propagation direction of electromagnetic radiation that passes locally through the second metallic plate 105.

In accordance with embodiments and, with reference to FIG. 7, each of the first through-holes 111 of the first metallic plate 104 may be substantially aligned with a corresponding one of the second through-holes 121 of the second metallic plate 105 even if the armored radome 100 is flat and planarized or curved. That is, as shown in FIG. 7, the respective longitudinal axes of the first through-holes 111 may be substantially parallel with the respective longitudinal axes of the corresponding second through-holes 121. In addition, the first through-holes 111 and the second through-holes 121 may have similar or different dimensions.

Figure 8:
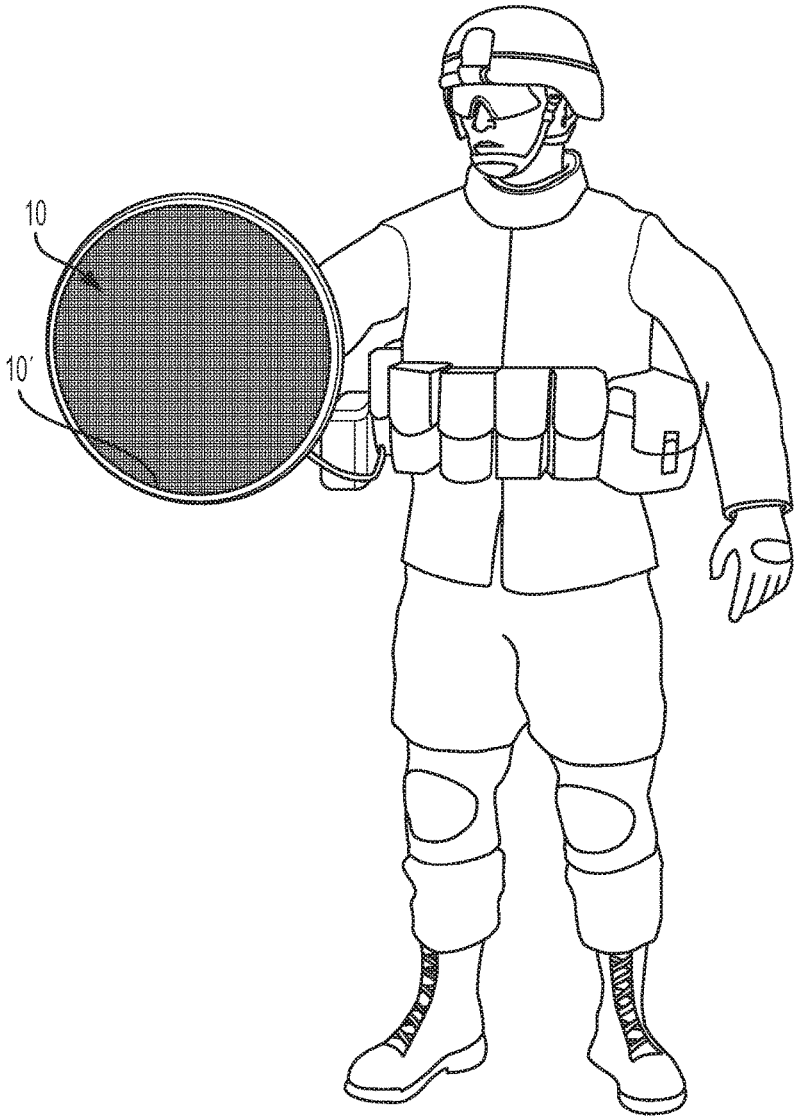
FIG. 8 is an illustration of an implementation of an SSADT system in accordance with embodiments.

With reference to FIG. 8, continuing advances in solid-state millimeter-wave technology, such as the armored radome 10 and the armored radome 100 described above, may soon make a portable SSADT system feasible. For example, as shown in FIG. 8, the armored radome 10 may be formed as a 16" diameter circular array 10' that weighs approximately 6.4 pounds and permits cooling airflow through the through-holes 21 to thereby remove heat generated by W-band power amplifiers. Though not shown, the armored radome 10 can be further provided with a handle in a rear section.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts and equivalents of all means or step plus function elements in the claims below are intended to include any structure, material or act for performing the function in combination with other claimed elements as claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments have been described, it will be understood that those skilled in the art, both now and in the future, may make various improvements and enhancements which fall within the scope of the claims which follow. These claims should be construed to maintain the proper protection for the invention first described.

What is claimed is:

1. An armored radome, comprising:

a metallic plate formed to define an array of through-holes, each through-hole having a respective longitudinal axis substantially aligned with electromagnetic radiation passing locally through the metallic plate; and a dielectric plate disposed substantially adjacent to the metallic plate with an air gap defined between the dielectric plate and the metallic plate.

2. The armored radome according to claim 1, wherein the metallic plate is about 0.25-1.00" thick, the through-holes are circular with an inside diameter of about 0.090-0.094" and the through-holes exhibit center-to-center spacing of about 0.115".

3. The armored radome according to claim 1, further comprising electrical-conductivity metallic plating disposed on the metallic plate.

4. The armored radome according to claim 1, wherein the array of the through-holes has varying geometries at various portions of the metallic plate.

5. The armored radome according to claim 1, wherein the metallic plate is curved.

6. The armored radome according to claim 1, further comprising dielectric filler disposed in the through-holes.

7. The armored radome according to claim 1, wherein the dielectric plate comprises polyethylene.

8. The armored radome according to claim 1, further comprising:

a second metallic plate disposed substantially adjacent to the dielectric plate with an air gap defined between the dielectric plate and the second metallic plate and formed to define an array of through-holes, each through-hole having a respective longitudinal axis substantially aligned with electromagnetic radiation passing locally through the metallic plate; and a second dielectric plate disposed substantially adjacent to the second metallic plate with an air gap defined between the second dielectric plate and the second metallic plate.

9. The armored radome according to claim 8, wherein the metallic plate and the second metallic plate are formed of different materials and the dielectric plate and the second dielectric plate are formed of different materials.

10. The armored radome according to claim 8, wherein the through-holes of the metallic plate and the through-holes of the second metallic plate are substantially aligned.

11. The armored radome according to claim 8, wherein the through-holes of the metallic plate and the through-holes of the second metallic plate have different dimensions.

12. An armored radome, comprising:

at least first, second and third dielectric plates; and at least first and second metallic plates respectively interleaved between the at least first, second and third dielectric plates with air gaps defined between each of the first, second and third dielectric plates and corresponding ones of the at least first and second metallic plates, the first metallic plate defining a first array of first through-holes each of which has a respective longitudinal axis substantially aligned with electromagnetic radiation passing locally through the first metallic plate, and the second metallic plate defining a second array of second through-holes each of which has a respective longitudinal axis substantially aligned with electromagnetic radiation passing locally through the second metallic plate.

13. The armored radome according to claim 12, further comprising electrical-conductivity metallic plating disposed on the first and second metallic plates.

14. The armored radome according to claim 12, wherein the first and second arrays each have varying geometries at various portions of the first and second metallic plates.

15. The armored radome according to claim 12, wherein the first and second metallic plates are curved.

16. The armored radome according to claim 12, further comprising dielectric filler disposed in the first and second through-holes.

17. The armored radome according to claim 12, wherein the first, second and third dielectric plates comprise polyethylene.

18. The armored radome according to claim 12, wherein the through-holes of the metallic plate and the through-holes of the second metallic plate are substantially aligned.

19. The armored radome according to claim 12, wherein the through-holes of the metallic plate and the through-holes of the second metallic plate have different dimensions.

* * * * *